US006711900B1

(12) United States Patent
Patel et al.

(10) Patent No.: US 6,711,900 B1
(45) Date of Patent: Mar. 30, 2004

(54) COMBUSTOR LINER V-BAND DESIGN

(75) Inventors: Bhawan Bhai Patel, Mississauga (CA); Parthasarathy Sampath, Mississauga (CA); Jason Araan Fish, Brampton (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 10/357,363

(22) Filed: Feb. 4, 2003

(51) Int. Cl.[7] ..... F23R 3/06
(52) U.S. Cl. ..... 60/752; 60/755; 60/757
(58) Field of Search ..... 60/752, 754, 755, 60/756, 757, 758, 760

(56) References Cited

U.S. PATENT DOCUMENTS

| | | | | | |
|---|---|---|---|---|---|
| 2,657,531 | A | * | 11/1953 | Pierce | 60/755 |
| 3,854,285 | A | * | 12/1974 | Stenger et al. | 60/756 |
| 4,050,241 | A | | 9/1977 | DuBell | |
| 4,422,300 | A | * | 12/1983 | Dierberger et al. | 60/757 |
| 4,700,544 | A | * | 10/1987 | Fucci | 60/757 |
| 4,749,029 | A | * | 6/1988 | Becker et al. | 60/755 |
| 4,749,298 | A | * | 6/1988 | Bundt et al. | 403/23 |
| 4,820,097 | A | * | 4/1989 | Maeda et al. | 165/168 |
| 4,833,881 | A | | 5/1989 | Vdoviak et al. | |
| 5,050,385 | A | | 9/1991 | Hirose et al. | |
| 5,077,969 | A | * | 1/1992 | Liang et al. | 60/766 |
| 5,233,828 | A | | 8/1993 | Napoli | |
| 5,241,827 | A | | 9/1993 | Lampes | |
| 5,265,425 | A | * | 11/1993 | Howell | 60/736 |
| 5,279,127 | A | | 1/1994 | Napoli | |
| 5,421,158 | A | | 6/1995 | Stenger et al. | |
| 5,435,139 | A | * | 7/1995 | Pidcock et al. | 60/757 |
| 5,560,198 | A | | 10/1996 | Brewer et al. | |
| 5,799,491 | A | * | 9/1998 | Bell et al. | 60/752 |
| 6,155,056 | A | | 12/2000 | Sampath et al. | |
| 6,286,317 | B1 | * | 9/2001 | Burrus et al. | 60/752 |
| 6,389,815 | B1 | | 5/2002 | Hura et al. | |

* cited by examiner

*Primary Examiner*—Ted Kim
(74) *Attorney, Agent, or Firm*—Ogilvy Renault

(57) ABSTRACT

A combustor wall louver for ducting a flow of compressed air through an inlet opening in the combustor wall from a source of compressed air outside the combustor where the louver is a circumferentially extending member, mounted to an interior surface of the combustor wall and covering the inlet opening with outlet openings fed by a channel in flow communication between each outlet opening and the inlet opening. Preferably, the circumferential member is made of arcuate segments of cast metal removably mounted to the interior surface of the combustor wall with threaded studs.

16 Claims, 11 Drawing Sheets

COMBUSTOR LINER V-BAND DESIGN

TECHNICAL FIELD

The invention relates to a combustor liner v-band louver, which may be manufactured of cast segments and removably fastened to the combustor liner.

BACKGROUND OF THE ART

Gas turbine engine combustors are relatively thin sheet metal shells surrounded by a plenum containing compressed air from the compressor. Air flows into the combustor through the fuel nozzles to mix with the fuel and through several small openings or louvers in the combustor liner wall which create an air curtain along the inside surface of the combustor liner, provide further air for combusting the fuel and create circulation currents of gas and air flowing within the combustor.

Conventional combustors may include circumferential V-shaped bands machined into inner wall surfaces, that protrude into the combustor from the liner surface or sheet metal double band louver, to generate single or double toroidial fluid flow in the primary combustion zone. In an annular combustor the toroidial flow increases gas residence time in the combustor and thereby improves the fuel/air mixing, engine efficiency and reduces emission levels.

Conventional so-called machined V-band louvers as well double band sheet metal louvers protrude into the hot gas path and are exposed to a harsh environment of rapidly flowing hot gases which tend to oxidize the metal liner material.

A particular disadvantage of conventional machined V-band or standard double band sheet metal louvers circumferential louvers is the development of axial cracks due to the high hoop stresses resulting from temperature differentials. Thermal expansion and contraction stresses exerted on the louver together with the high temperatures expose these protruding components of the combustor wall to durability problems including cracking and oxidation.

Further, V-band lovers or other similar machined louvers are very expensive to manufacture and often require repair during engine overhauls. Conventional combustor liner designs however incorporate the V-band louvers in the unitary machined structure of the combustor liner, and so repair is required to the liner itself.

It is an object of the present invention to provide a more cost effective means of generating the single or double toroidal flow in the primary zone of the combustor liner.

It is a further object of the invention to reduce or eliminate the high hoop stresses in the combustor liner which promote the development of axial cracks in the prior art.

It is a further object of the invention to reduce the cost of manufacture and repair of a combustor liner.

Further objects of the invention will be apparent from review of the disclosure, drawings and description of the invention below.

DISCLOSURE OF THE INVENTION

The invention provides a combustor wall louver for ducting a flow of compressed air through an inlet opening in the combustor wall from a source of compressed air outside the combustor where the louver is a circumferentially extending band member, mounted to an interior surface of the combustor wall and covering the inlet opening with outlet openings fed by a channel in flow communication between each outlet opening and the inlet opening. Preferably, the circumferential band member is made of arcuate segments of cast metal removably mounted to the interior surface of the combustor wall with threaded studs.

As in the prior art, the primary function of the machined V-band/sheet metal double band louver is to generate single or double toroidal flow pattern in the combustor liner to promote fuel combustion efficiency, increase residence time and reduce emissions. However the invention permits reduction in machining required to create the toroidial flow inducing feature in the combustor liner, easing the assembly due to bolted construction and permitting repair or replacement of only the damaged sections through use of separate segments to assemble a circumferential band member about the combustor liner wall.

A benefit of the segmental construction is the reduction of hoop stresses and increasing of the fatigue life of the V-band. Prior art designs induce significant hoop stresses due to the unitary annular structure when exposed to temperature differentials or fluctuations. By creating separate, preferably cast, segments which are assembled together to form the circumferential louver assembly, hoop stresses and axial cracking due to thermal expansion and contraction can be reduced.

In addition, the segmental construction permits a higher degree of assembly and manufacturing tolerance and permits the segments to be manufactured of metals or other materials which have different oxidation or other characteristics and different fatigue strength than the combustor liner to which they are releasably fastened. A segmented cast metal construction is more cost effective to manufacture than conventional designs due to reduced machining, and assembly is simplified by the bolted connection. These features result in lower cost operation since oxidation damaged sections can be replaced individually in a simple bolted connection.

A further advantage of the invention is the diversion of any leakage between the cast V-band segment and the section of the combustor liner wall to which it is releasable attached. Leakage of air through any gap between the cast V-band segment and the combustor liner forms a beneficial film or curtain cooling layer adjacent the liner in the immediate local area.

DESCRIPTION OF THE DRAWINGS

In order that the invention may be readily understood, embodiments of the invention are illustrated by way of example in the accompanying drawings.

FIG. 3 shows the separate cast metal combustor wall louver band mounted with threaded studs to the interior surface of the combustor wall.

FIG. 4 is a detailed view of the louver shown in FIG. 3.

FIG. 5 is a partial isometric view of the outer combustor with inlet openings and louver bands with threaded studs for mounting purposes.

FIG. 6 is an interior isometric view of the combustor wall louver.

FIG. 7 is an outer view of a combustor wall louver segment showing three threaded studs and the interior channel with outlet openings.

FIG. 8 is an interior isometric view of the combustor wall louver segment shown in FIG. 7.

Further details of the invention and its advantages will be apparent from the detailed description included below.

DETAILED DESCRIPTION OF PREFERRED EMBODIMENTS

Figure 1:
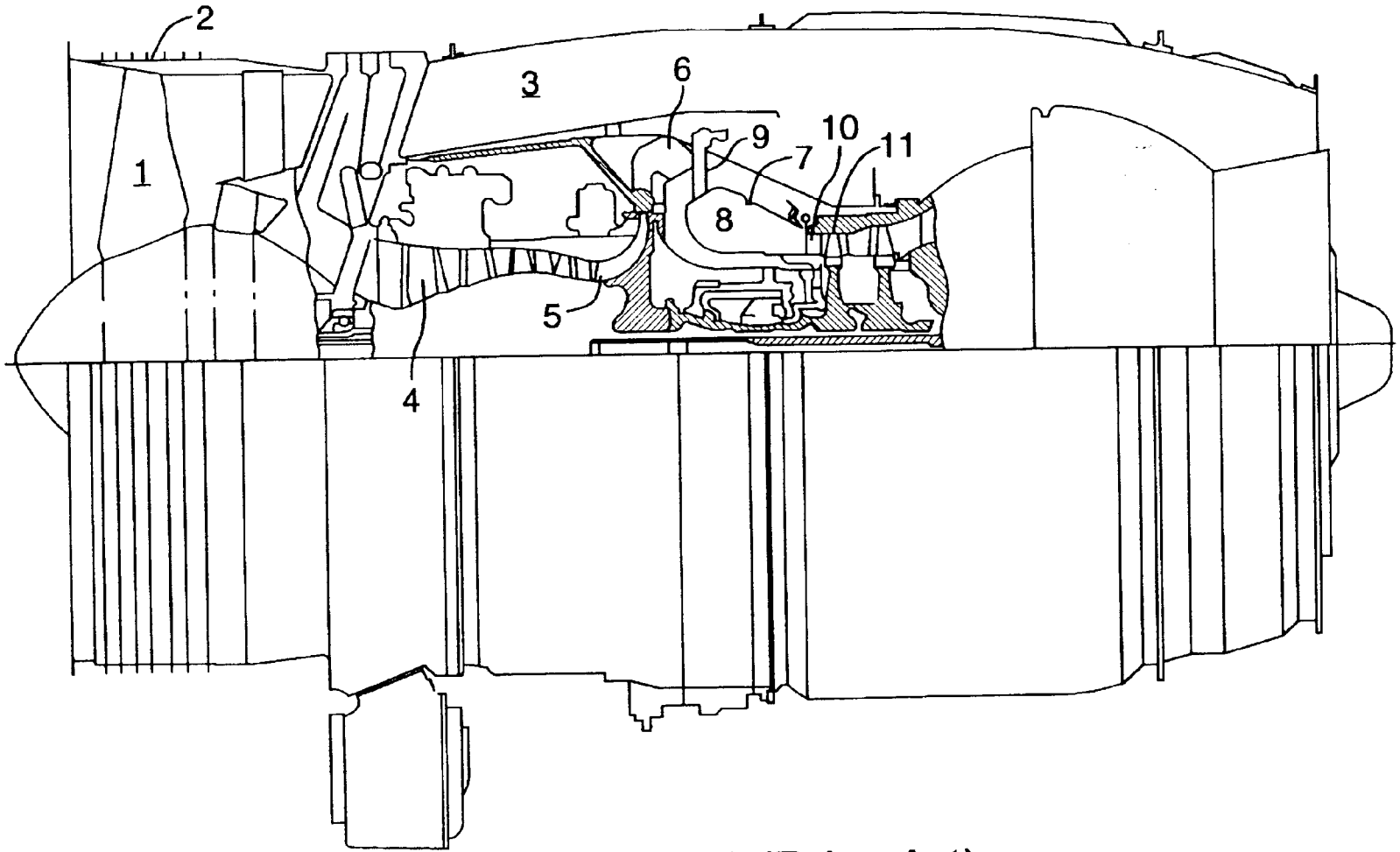
FIG.1 (Prior Art)
FIG. 1 is an axial cross-sectional view through a turbofan gas turbine engine showing a general arrangement of components including the location of combustor.

FIG. 1 shows an axial cross-section through a typical turbofan gas turbine engine. It will be understood however that the invention is equally applicable to any type of engine with a combustor such as a turboshaft, a turboprop, auxiliary power unit, gas turbine engine or industrial gas turbine engine. Air intake into the engine passes over fan blades 1 in a fan case 2 and is then split into an outer annular flow through the bypass duct 3 and an inner flow through the low-pressure axial compressor 4 and high-pressure centrifugal compressor 5. Compressed air exits the compressor 5 through a diffuser 6 and is contained within a plenum 7 that surrounds the combustor 8. Fuel is supplied to the combustor 8 through fuel tubes 9 which is mixed with air from the plenum 7 when sprayed through nozzles into the combustor 8 as a fuel air mixture that is ignited. A portion of the compressed air within the plenum 7 is admitted into the combustor 8 through orifices in the side walls to create a cooling air curtain along the combustor walls or is used for cooling to eventually mix with the hot gases from the combustor and pass over the nozzle guide vane 10 and turbines 11 before exiting the tail of the engine as exhaust. It will be understood that the foregoing description is intended to be exemplary of only one of many possible configurations of engine suitable for incorporation of the present invention.

Figure 2A:
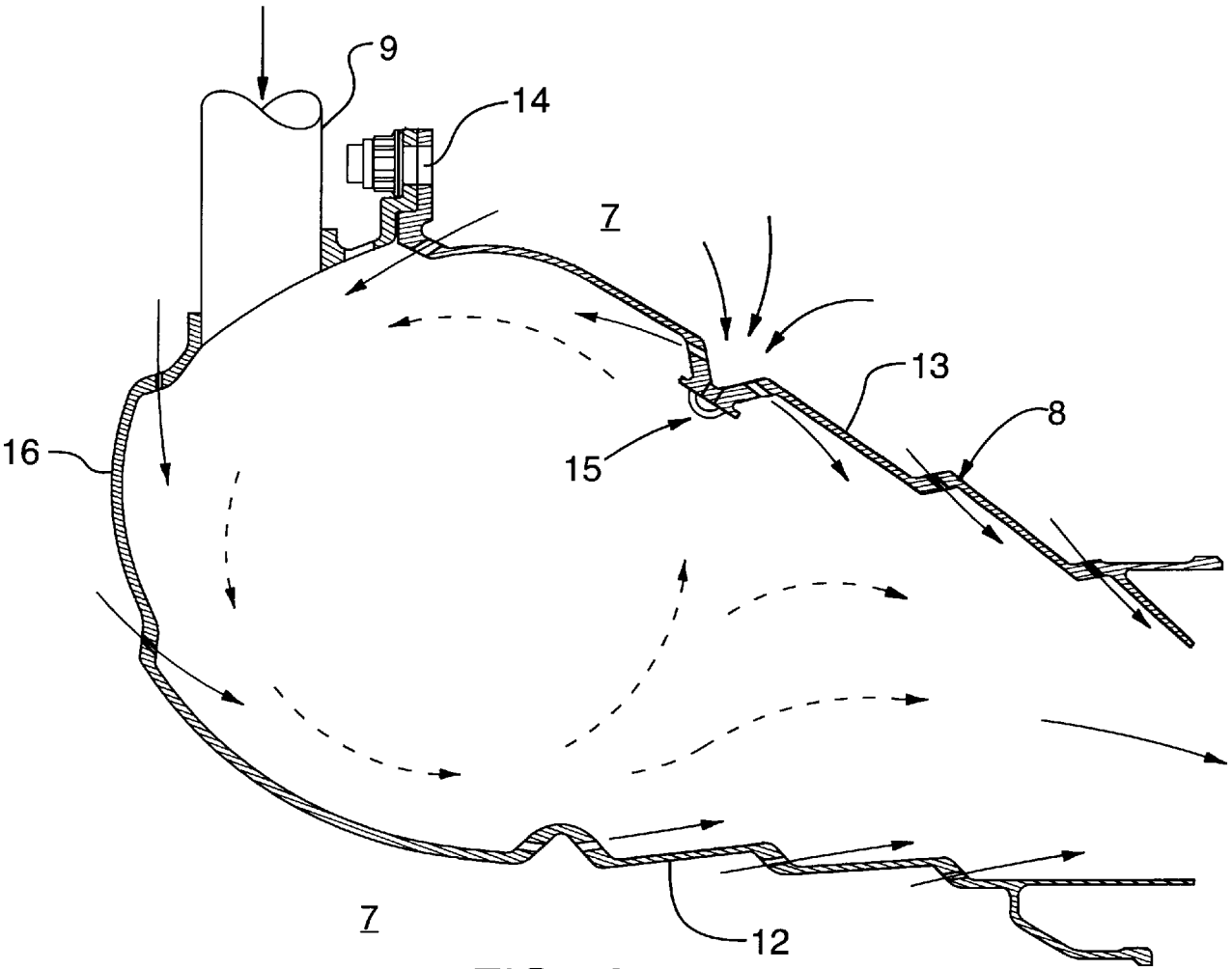
FIG.2A (PRIOR ART)
FIG. 2*a* is an axial cross-sectional view through a combustor liner showing an inner and an outer V-band of conventional prior art design.
Figure 2B:
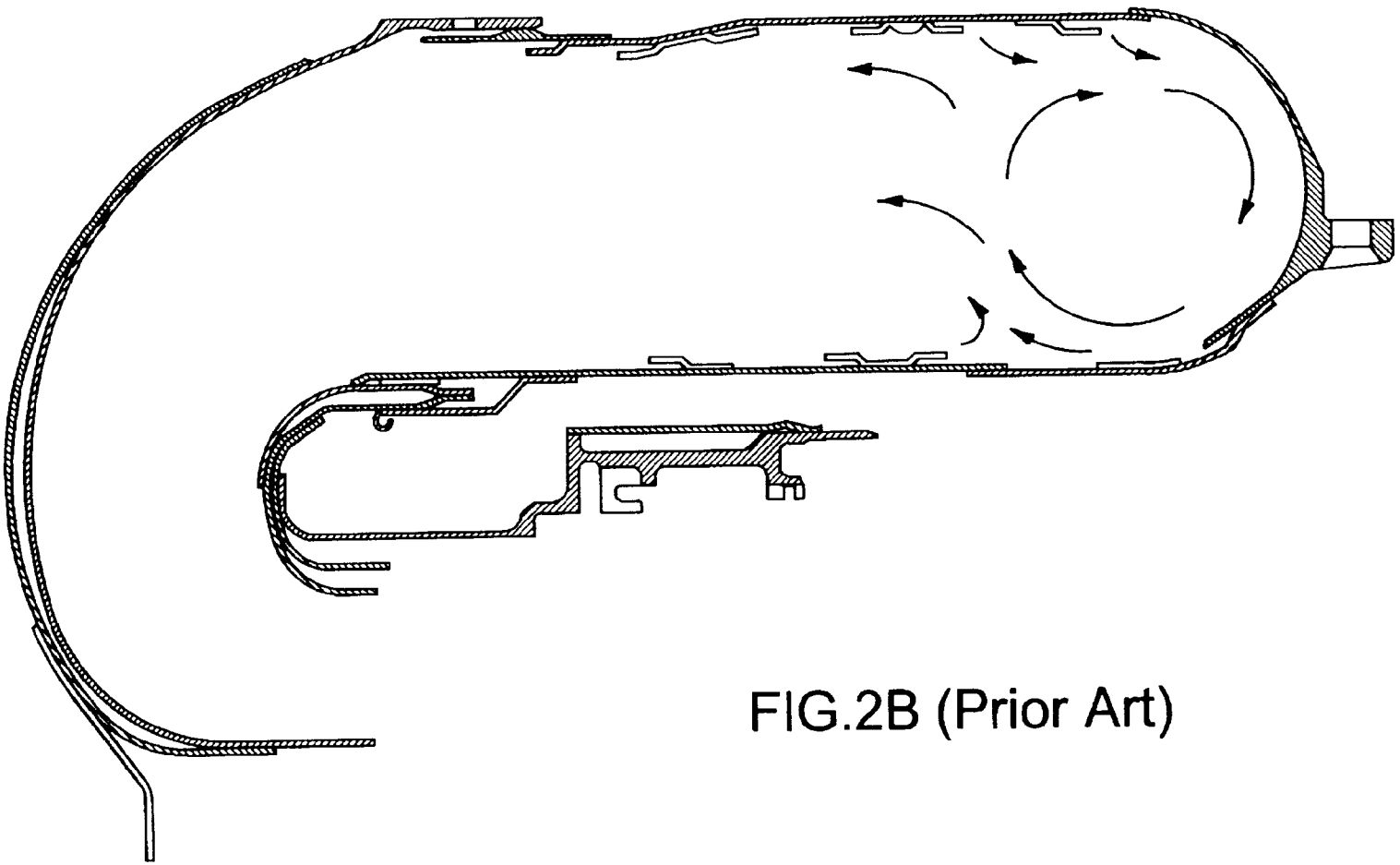
FIG.2B (Prior Art)
FIG. 2*b* shows a cross section view of a sheet metal double band louver also of conventional prior art design.

FIGS. 2*a* and 2B show a detailed axial cross sectional view through a combustor 8 with a prior art integral machined V-band or sheet metal double band louver 15. The fuel supply tube 9 is shown, however the fuel nozzle arrangement has not been shown, for simplicity. The inner combustor wall 12 and outer combustor wall 13 are joined with a bolted connection 14. Of interest to the present invention, the outer combustor wall 13 includes a conventional prior art integral V-band louver 15 that admits air from the plenum 7 into the interior of the combustor 8 to create a toroidal flow of fuel/air mixture within the combustor dome 16, as indicated with arrows in FIG. 2.

Figure 3:
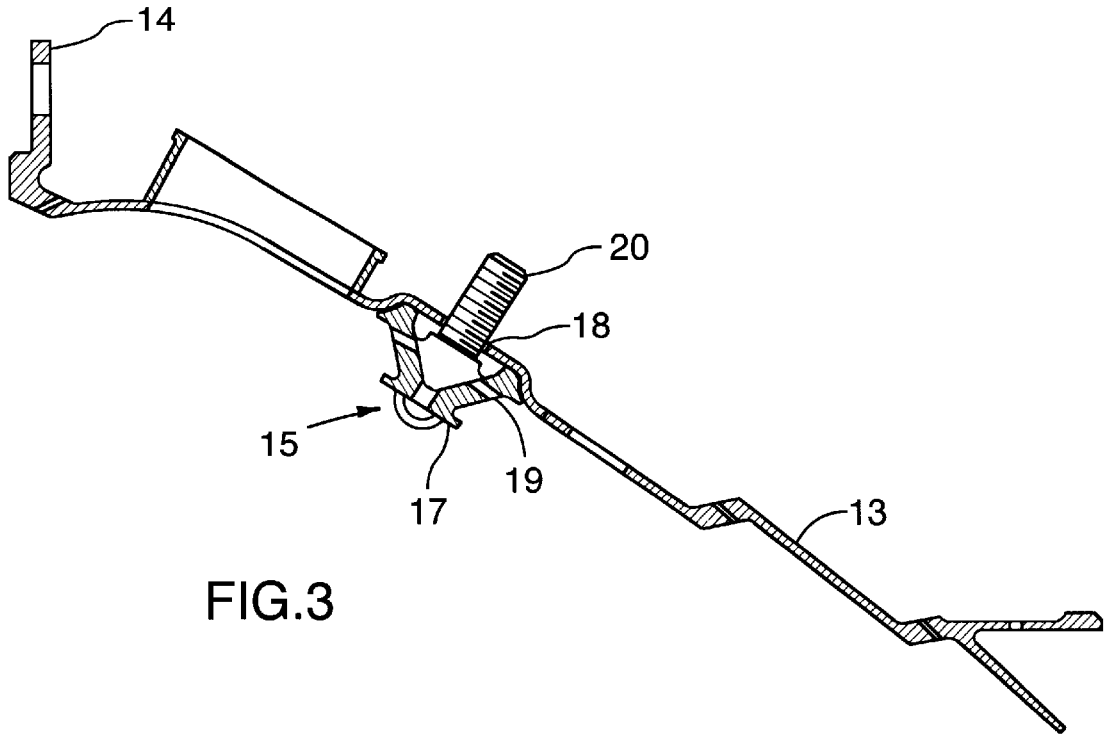
FIGS. 3–8 show a first embodiment of the invention, where
Figure 5:
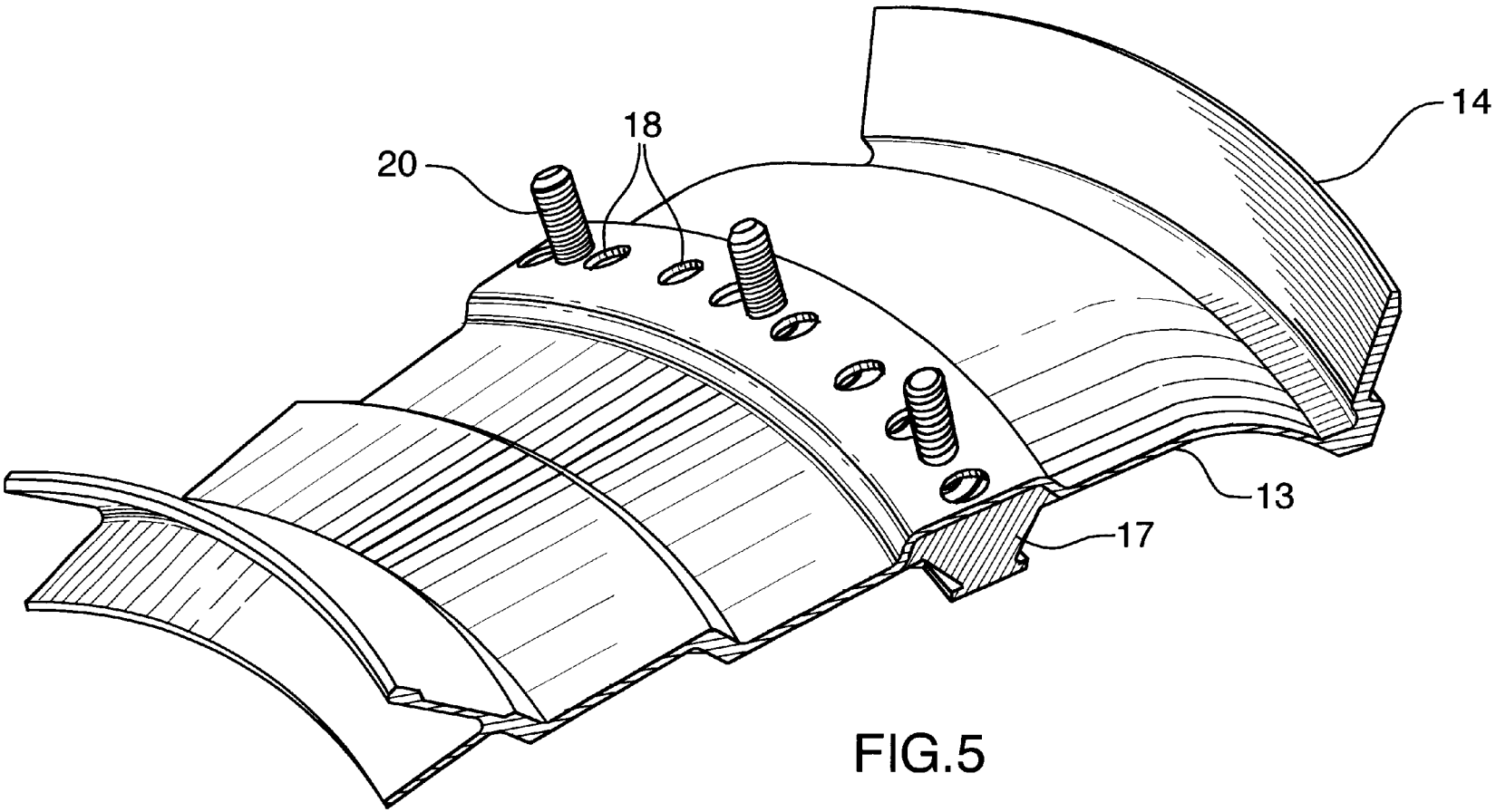

FIG. 3 shows a detailed view of the outer combustor wall 13 with flanged connection 14. In accordance with the invention, a combustor wall louver 15 comprising a circumferentially extending band member 17 is releasably mounted to the interior surface of the combustor wall 13 and covers a series of inlet openings 18 (which are best seen in FIG. 5). Compressed air flows through the inlet openings 18 in the combustor wall 13 from the surrounding plenum 7.

Figure 6:
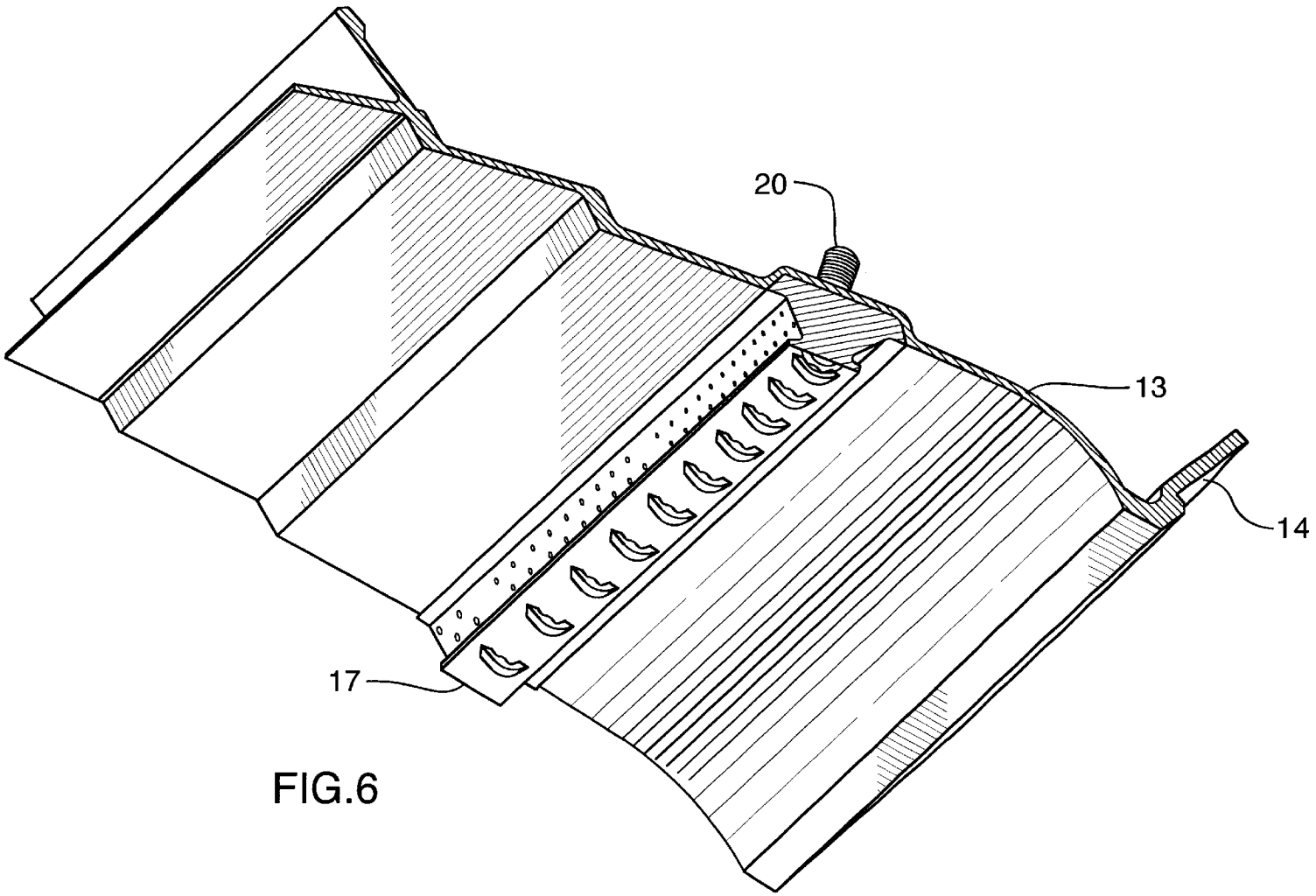

The band 17 includes a large number of laterally extending outlet openings 19 (best seen in FIG. 6). The circumferentially extending band 17 is mounted to the interior surface of the combustor wall 13 with threaded studs 20 through openings. The generally V-shaped band 17 preferably includes a central channel 21 in flow communication with each outlet opening 19 and with the inlet openings 18.

Figure 8:
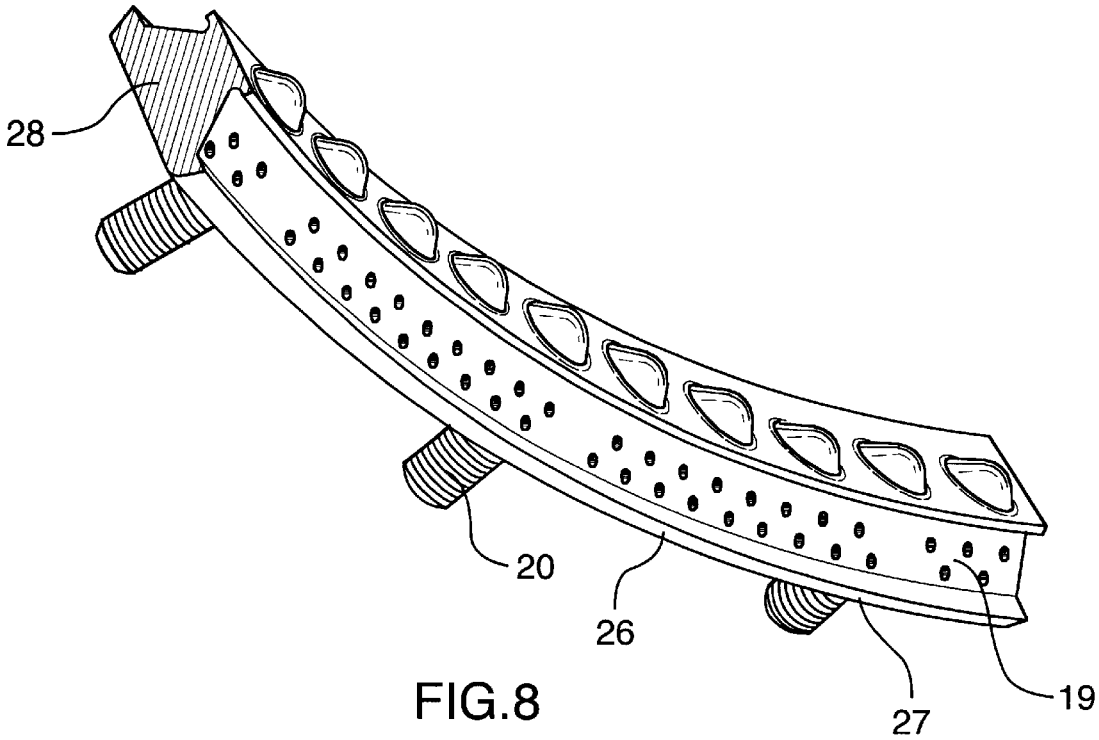

In the first embodiment shown in FIGS. 3–8, the band 17 includes an inner circumferential surface 22 which protrudes into the interior of the combustor 8 and is exposed to hot gas flow. In order to provide cooling, the inner circumferential surface 22 preferably includes thumb nail cooling air openings 23 communicating with the channel 21 through radial bores 24. As shown in FIGS. 6 and 8, the cooling air openings 23 are preferably disposed in an inward spirally directed cooling vent 25.

Figure 7:
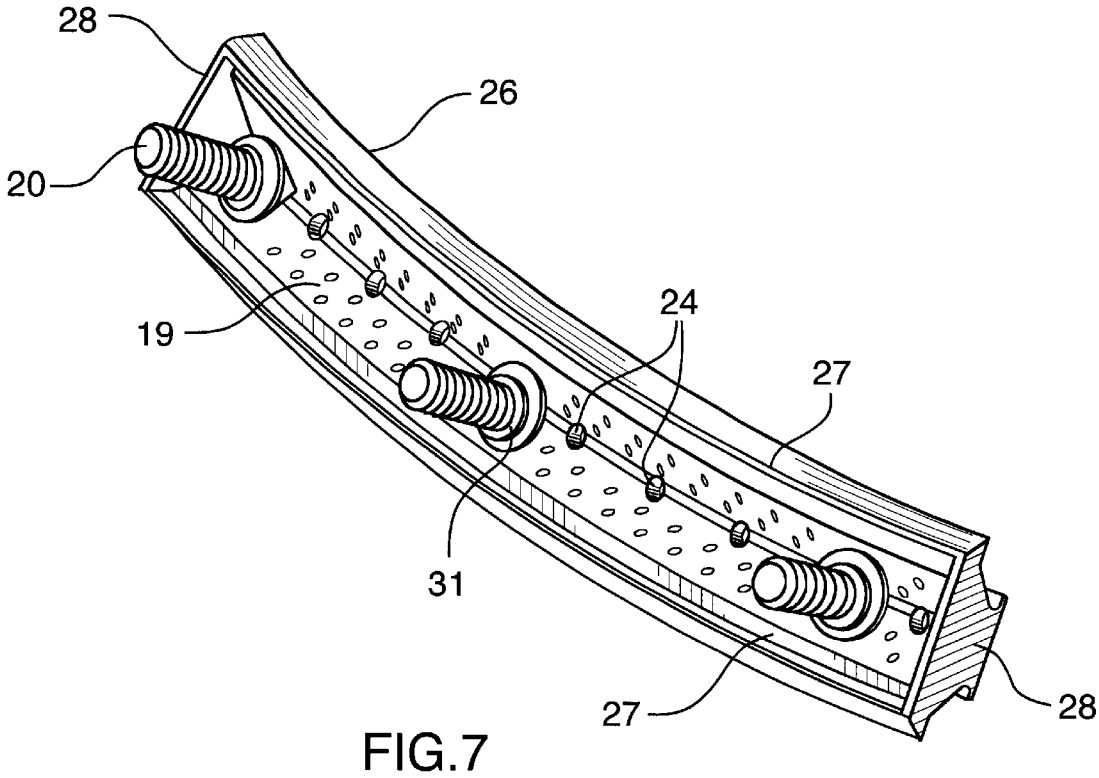

As best seen in FIGS. 7 and 8, preferably, the circumferentially extending band 17 is made of a number of arcuate segments 26, each removably mounted to the interior surface of the combustor wall 13 with threaded studs 20. The segments 26 of the circumferentially extending band 17 have combustor wall abutting edges 27 bounding the air flow channel 21. Each segment 26 (shown in FIGS. 7 and 8) includes two combustor wall abutting end bulkheads 28 which circumferentially contained the compressed air within the channel 21 to flow out into the combustor through outlet openings 19 and through cooling air openings 23 via bores 24.

Figure 4:
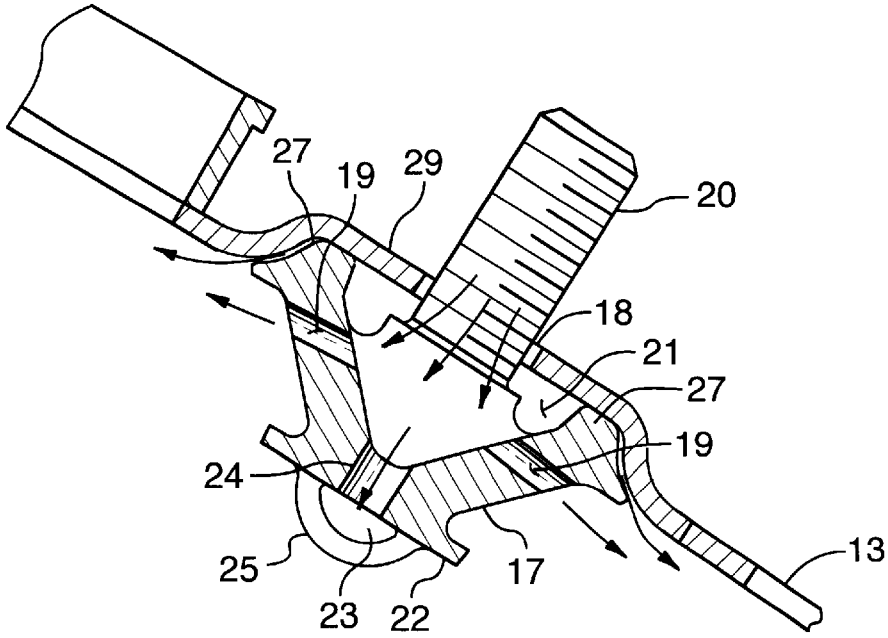

In the first embodiment (shown in FIGS. 3 to 8) the combustor wall 13 has a recessed groove. The combustor wall abutting edges 27 of the circumferential band 17 engage the recessed groove 29 in a generally close fitting manner in order to ensure that the bulk of compressed air progresses through inlet openings 18 and out through outlet openings 19 or through bore 24. However as indicated in FIG. 4, a certain amount of leakage may escape through an air curtain gap defined between the interior surface of the combustor wall 13 and the combustor wall abutting edges 27 of the louver 17 to create a beneficial cooling air film or curtain. To simplify manufacture and assembly, as well as reduce stress concentration, the recessed groove has sloped side walls and a circumferential bottom wall into which the inlet openings 18 are provided (in FIG. 4).

Figure 9:
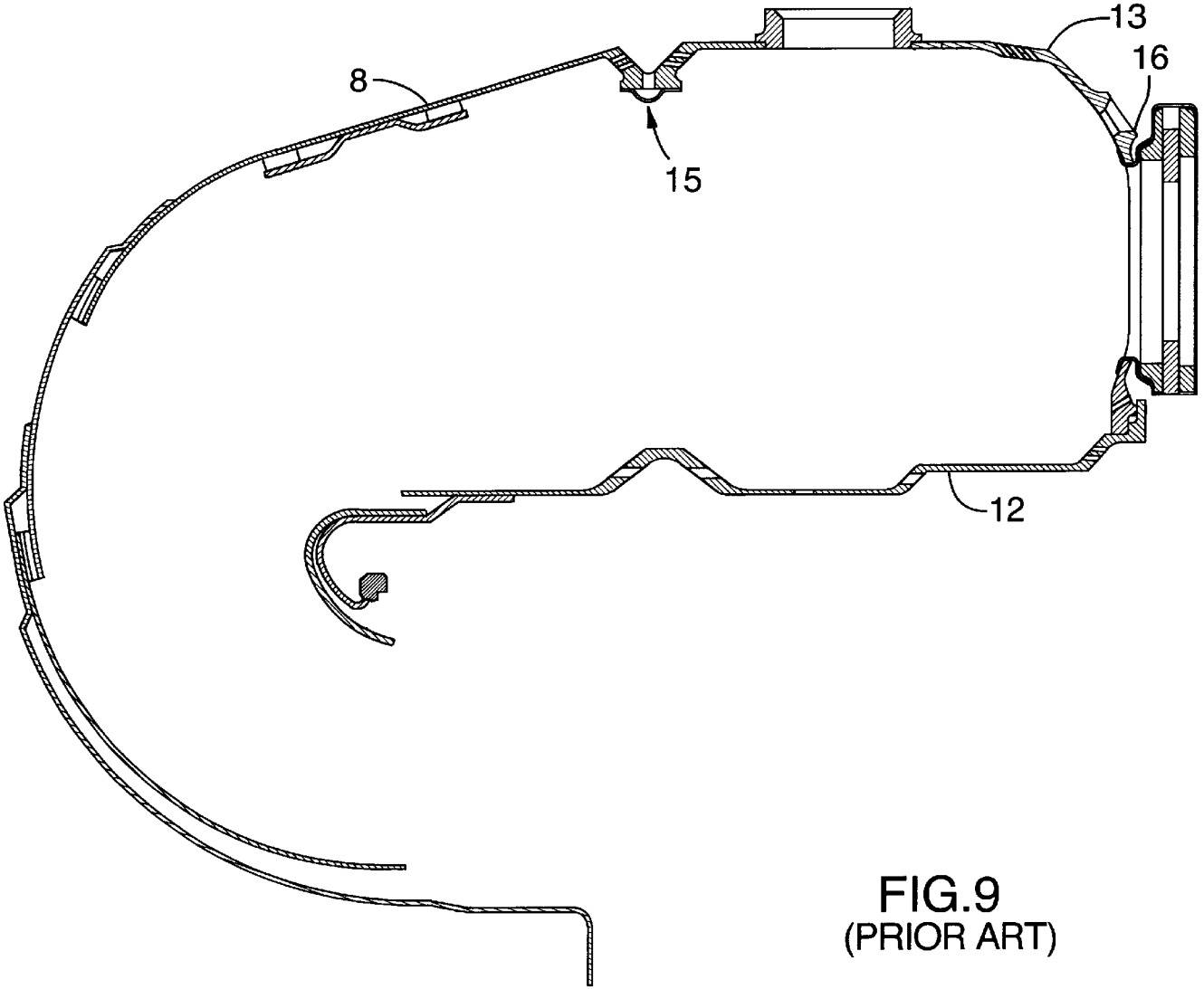
FIG.9 (PRIOR ART)
FIG. 9 is an axial cross sectional view through a prior art reverse flow combustor liner.
Figure 10:
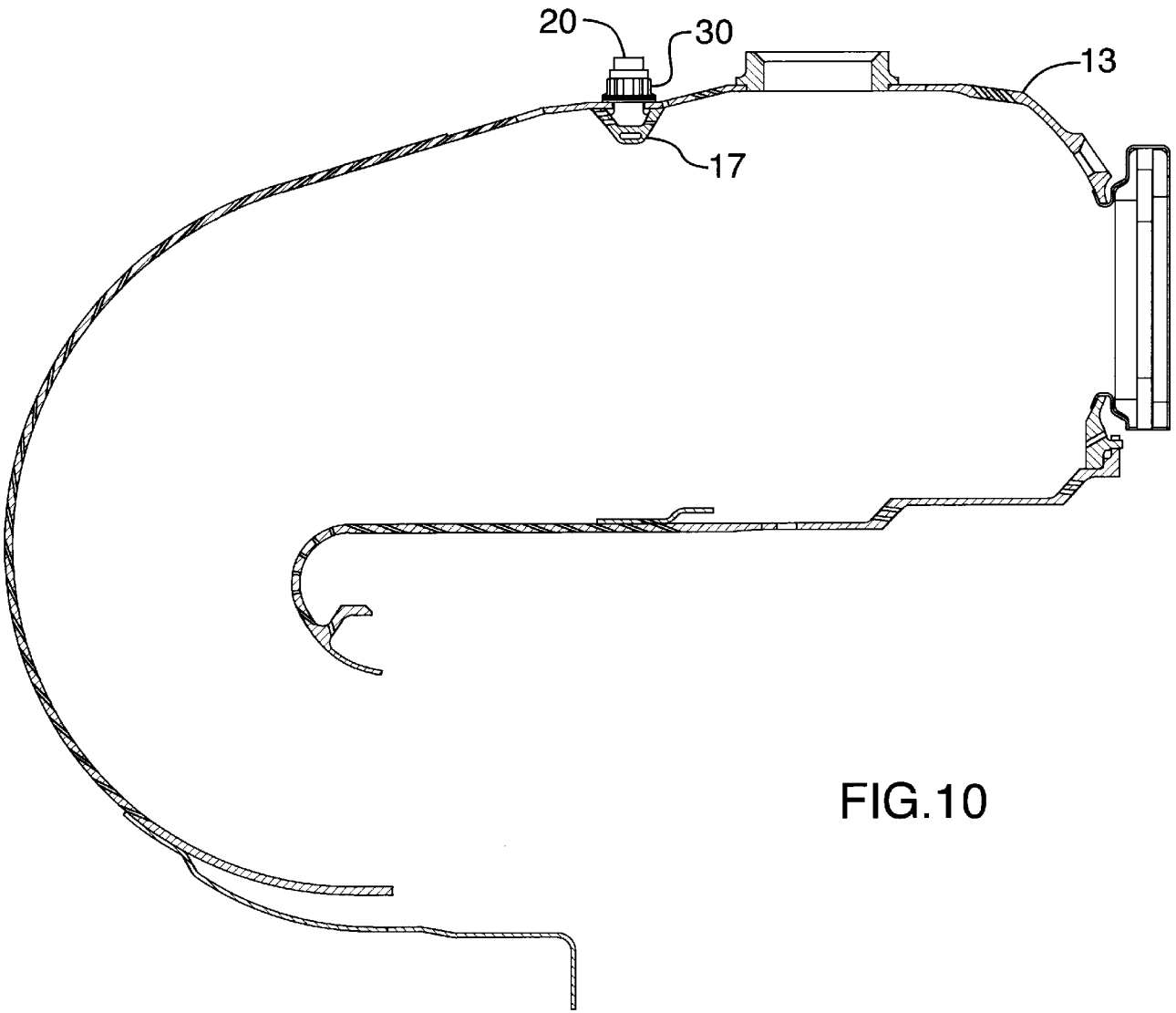
FIG. 10 is a like axial sectional view through a reverse flow combustor liner with segmented louver (according to a second embodiment) mounted to the combustor liner with threaded studs.
Figure 11:
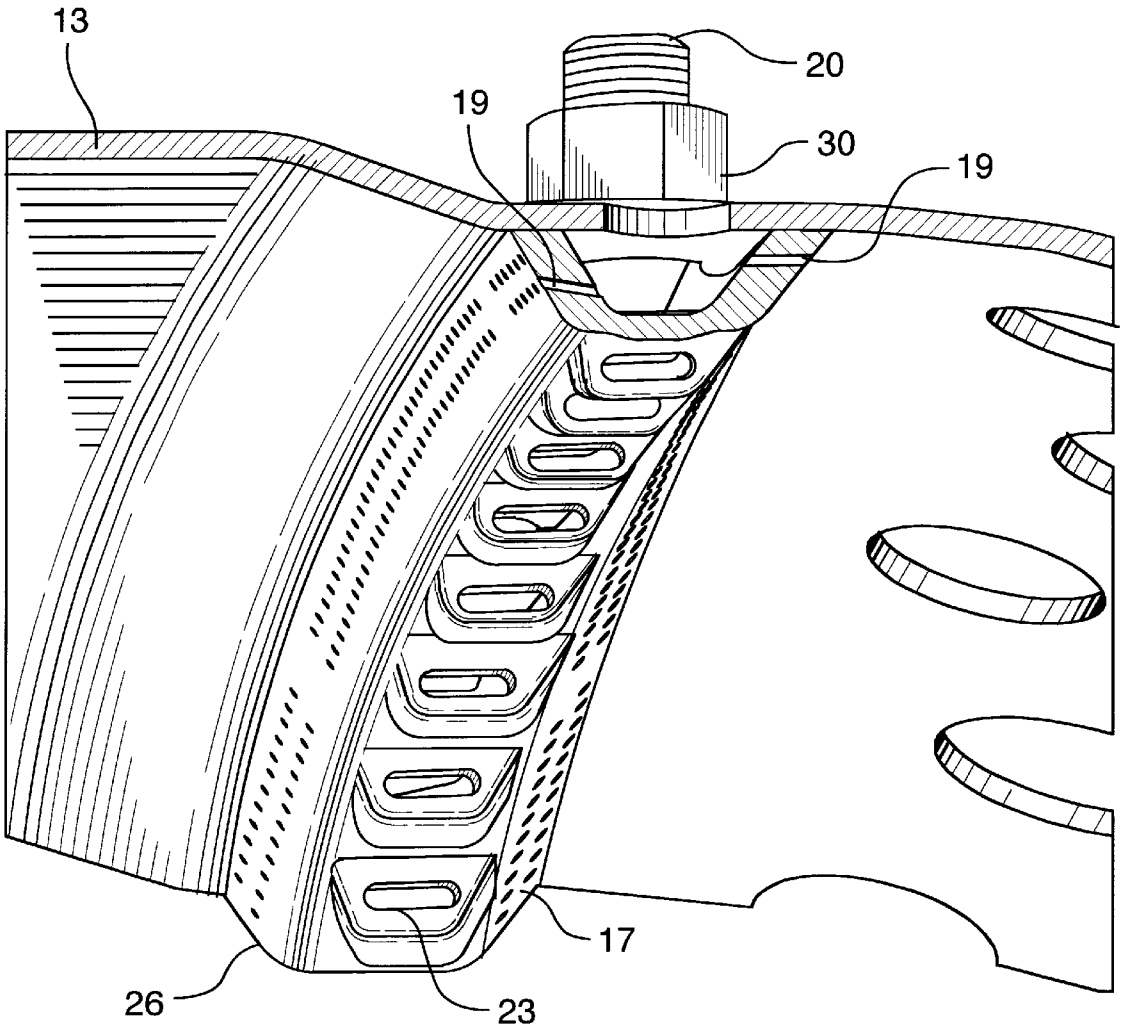
FIG. 11 is an interior isometric view of the combustor wall louver segment mounted to the combustor liner wall with threaded studs.
Figure 12:
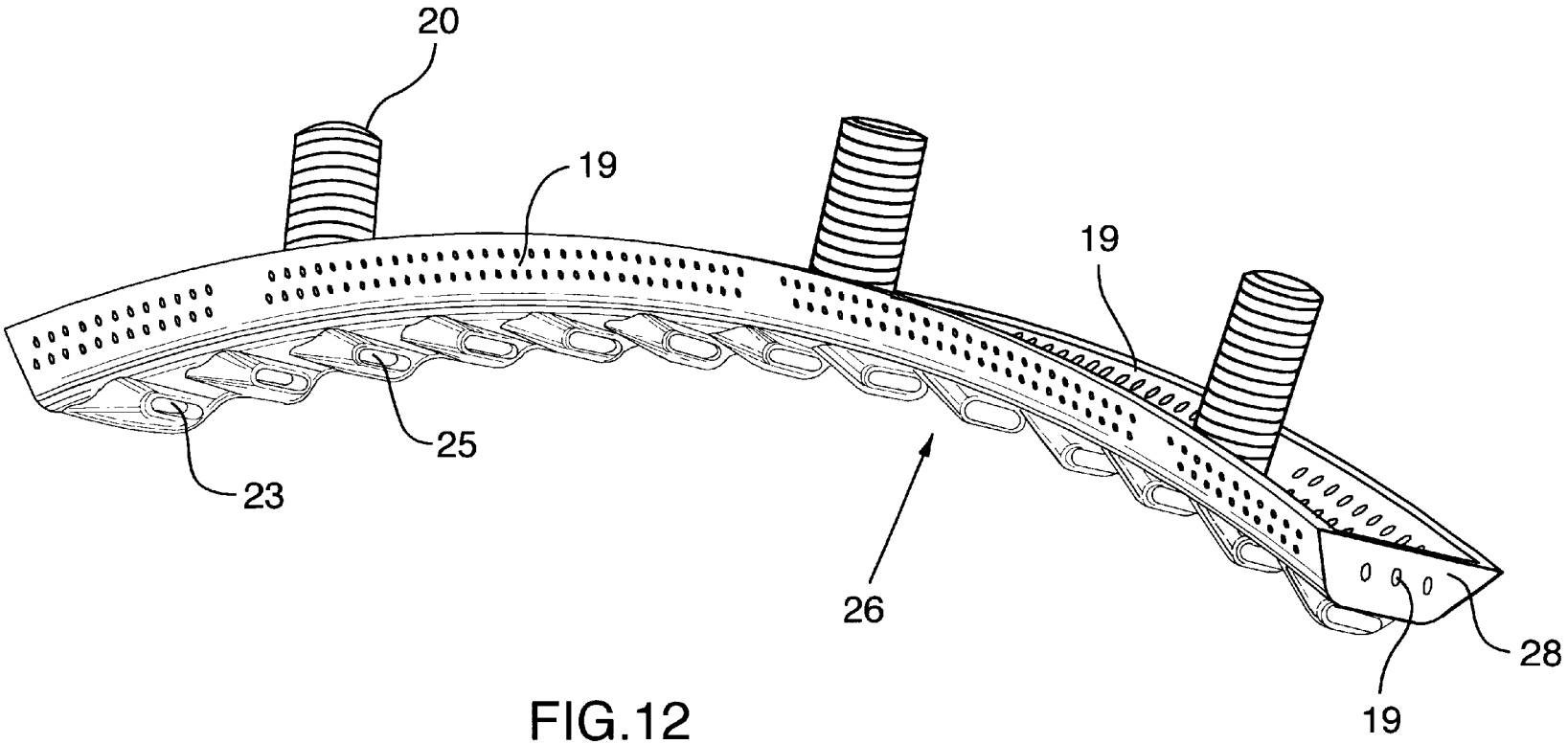
FIG. 12 is a side isometric view of a combustor wall louver segment showing internal channel with outlet openings and threaded studs for mounting to the combustor wall.

The remaining FIGS. 10 through 12 illustrate a second embodiment of the invention applied to replace the V-band louver 15 of a prior art reverse flow combustor 8 shown in FIG. 9. In the prior art arrangement illustrated in FIG. 9, the V-band groove 15 is disposed in the outer combustor wall 13 which is connected to the inner combustor wall with the dome 16. The fuel nozzles and fuel supply tubes are omitted for clarity.

FIG. 10 illustrates the replacement of the V-band louver 15 with a circumferentially extending band 17 mounted to the interior surface of the outer combustor wall 13 and covering inlet openings 18 in a manner similar to that described above in respect of the first embodiment. However, as best shown in FIGS. 11 and 12, the segments 26, that are assembled into a circumferentially extending band 17, are mounted flush with the internal surface of the combustor wall 13 (not in a groove 29 as the first embodiment). The flush mounting arrangement somewhat simplifies machining, assembly and manufacture, and it's use is not dictated by the combustor configuration.

As best seen in FIG. 11, the threaded studs 20 extend from the band 17 through the combustor wall 13 with removable nuts 30 externally fastened to the studs 20. Vents 25 and laterally extending outlet openings 19 expel air jets as described above in relation to the first embodiment. As seen in FIG. 12 however, the bulkheads 28 also include at least one outlet opening 19 for cooling and purging hot gases from the area between abutting segments 26.

It will be appreciated from the above description and particularly FIGS. 7, 8 and 12, that each segment 26 can be easily manufactured as a shallow arcuate metal casting which may require minimal machining to meet tolerances or form the outlet openings 19 for example. The studs 20 in FIG. 7 extend from a raised boss 31 within the channel 21. The boss 31 reinforces the local area but does not significantly impede the free flow of compressed air through the channel 21.

Although the above description relates to a specific preferred embodiment as presently contemplated by the inventors, it will be understood that the invention in its broad aspect includes mechanical and functional equivalents of the elements described herein. It will also be understood that certain changes will also be apparent to those skilled in the art which may be made to the disclosed embodiments without departing from the invention described herein. For example, the invention may be applied to any combustor in which a V-band may beneficially produce a toroidial flow. The invention may be fastened to a combustor by any suitable means. Furthermore, the invention need not be cast but other suitable fabrication means may be employed. Still other changes will be apparent to those skilled in the art, and it is understood that such changes do not depart from the scope of claims below.

We claim:

1. A combustor wall louver, for ducting a flow of compressed air through at least one inlet opening in a combustor wall from a source of compressed air outside the combustor wall, the louver comprising:

a circumferentially extending member having circumferentially extending side walls, mounted to an interior surface of the combustor wall forming an enclosed space and at least partially covering the at least one inlet opening, the member having: a plurality of outlet openings in flow communication with an inlet opening, the outlet openings oriented relative to the combustor wall to generate a toroidial flow of gases within the combustor.

2. A combustor wall louver according to claim 1 wherein the circumferentially extending member includes a channel in flow communication between at least one inlet and at least one outlet.

3. A combustor wall louver according to claim 1 wherein the circumferentially extending member is a band comprised of a plurality of arcuate segments.

4. A combustor wall louver according to claim 3 wherein each segment includes two combustor wall abutting end bulkheads bounding a channel there between.

5. A combustor wall louver according to claim 4 wherein each bulkhead includes at least one outlet opening.

6. A combustor wall louver according to claim 1 wherein the member is removably mounted to the interior surface of the combustor wall with mechanical fasteners.

7. A combustor wall louver according to claim 6 wherein the member is mounted with removable fasteners.

8. A combustor wall louver according to claim 7 wherein the removable fasteners include threaded studs extending from the member through the combustor wall with removable nuts externally fastened thereon.

9. A combustor wall louver according to claim 8 wherein the studs extend from a raised boss within a channel.

10. A combustor wall louver according to claim 1 wherein the circumferentially extending member has combustor wall abutting edges bounding a channel.

11. A combustor wall louver according to claim 10 wherein the combustor wall has a recessed groove and the combustor wall abutting edges engage the recessed groove.

12. A combustor wall louver according to claim 11 wherein the recessed groove has sloped side walls and a circumferential bottom wall with said inlet openings disposed in the bottom wall.

13. A combustor wall louver according to claim 1 wherein the member includes an inner circumferential surface with cooling air openings in communication with a channel.

14. A combustor wall louver according to claim 13 wherein the cooling air openings are disposed in an inward spirally directed cooling vent.

15. A combustor comprising a wall, having:

an inlet opening in communication with a source of compressed air outside the combustor;

a louver comprising a circumferentially extending member, mounted to an interior surface of the combustor wall and covering the inlet opening, the member having: a plurality of outlet openings; and a channel in flow communication between each outlet opening and the inlet opening, the circumferentially extending member having combustor wall abutting edges bounding the channel; and an air curtain gap defined between the interior surface of the combustor wall and the combustor wall abutting edges of the louver.

16. A gas turbine engine comprising:

a compressor portion;

a turbine portion; and a combustor portion, the combustor portion including at least one combustor wall and a louver member, the louver member having circumferentially extending side walls mounted to the combustor wall forming an enclosed space and extending circumferentially around an interior surface of the combustor wall, the combustor wall having at least one air flow opening therein, wherein the louver member is mounted to the interior surface of the combustor wall so that at least one louver outlet opening communicates with the air flow opening in the combustor wall, the outlet opening oriented relative to the combustor wall to generate a toroidial flow of gases within the combustor.

* * * * *